US011933204B2

(12) United States Patent
Koci et al.

(10) Patent No.: US 11,933,204 B2
(45) Date of Patent: Mar. 19, 2024

(54) SYSTEMS AND METHODS FOR THERMAL BARRIER COATINGS TO MODIFY ENGINE COMPONENT THERMAL CHARACTERISTICS

(71) Applicant: Caterpillar Inc., Peoria, IL (US)

(72) Inventors: Chad Palmer Koci, Washington, IL (US); Kenth I. Svensson, Peoria, IL (US); Eric Donald Wiebrecht, Germantown Hills, IL (US); Venkatesan Veeriah, Chennai (IN); Qingzhong Li, Peoria, IL (US); Suresh Babu Chennagowni, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/848,076

(22) Filed: Jun. 23, 2022

(65) Prior Publication Data

US 2023/0417162 A1 Dec. 28, 2023

(51) Int. Cl.
*F01L 3/04* (2006.01)
*C23C 26/00* (2006.01)

(52) U.S. Cl.
CPC ..... *F01L 3/04* (2013.01); *C23C 26/00* (2013.01); *F01L 2301/00* (2020.05)

(58) Field of Classification Search
CPC ..... C23C 26/00; F01L 3/04
See application file for complete search history.

(56) References Cited

U.S. PATENT DOCUMENTS

| | | | |
|---|---|---|---|
| 5,384,200 | A | 1/1995 | Giles et al. |
| 5,723,078 | A | 3/1998 | Nagaraj et al. |
| 7,171,936 | B2 | 2/2007 | Rein et al. |
| 7,712,216 | B1 | 5/2010 | Woehlke et al. |
| 8,568,827 | B2 | 10/2013 | Liu et al. |
| 8,677,813 | B2 | 3/2014 | Sellars et al. |
| 9,021,874 | B2 | 5/2015 | Bethke et al. |
| 9,840,982 | B2 | 12/2017 | Shimoda et al. |
| 9,926,830 | B2 | 3/2018 | Warey et al. |
| 9,939,364 | B2 | 4/2018 | Zhou et al. |

(Continued)

FOREIGN PATENT DOCUMENTS

| | | |
|---|---|---|
| CN | 101776645 B | 7/2010 |
| CN | 107575277 A | 1/2018 |

(Continued)

*Primary Examiner* — Kevin A Lathers
(74) *Attorney, Agent, or Firm* — Lee & Hayes, P.C.

(57) ABSTRACT

An engine component comprises one or more thermal barrier coatings applied to one or more areas of the engine component. The thermal barrier coatings reduce the temperature rate of change of the areas to which the thermal barrier coating is applied. Reducing the temperature rate of change can help reduce lattice structure damage caused by different temperatures in different areas of the engine component. The thermal barrier coating can be applied as a monolithic layer on a surface of the engine component or can be applied in different areas using patterns. The patterns allow for the tuning of the performance characteristics (temperature rate of change) of the areas of the engine component and can help reduce defect propagation, such as cracks, in the thermal barrier coating from one area of the thermal barrier coating to other areas of the thermal barrier coating.

20 Claims, 8 Drawing Sheets

(56) References Cited

U.S. PATENT DOCUMENTS

| | | | | |
|---|---|---|---|---|
| 10,066,546 | B2 | 9/2018 | Yamashita et al. | |
| 10,082,072 | B2 * | 9/2018 | Guo | F02B 47/02 |
| 10,519,854 | B2 | 12/2019 | Lineton et al. | |
| 10,876,475 | B2 | 12/2020 | Lineton | |
| 11,193,402 | B2 * | 12/2021 | Ritter | F01L 3/22 |
| 2010/0077983 | A1 * | 4/2010 | Yamada | F01L 3/04 123/188.9 |
| 2013/0269666 | A1 * | 10/2013 | McAlister | F16J 15/0806 123/668 |
| 2016/0138515 | A1 | 5/2016 | Baek et al. | |
| 2016/0348546 | A1 * | 12/2016 | Kurahashi | F01L 3/04 |

FOREIGN PATENT DOCUMENTS

| | | | |
|---|---|---|---|
| CN | 109653892 | A | 4/2019 |
| CN | 109763088 | A | 5/2019 |
| JP | 2005337180 | A | 12/2005 |
| JP | 2012072745 | A | 4/2012 |
| RU | 2079685 | C1 | 5/1997 |
| WO | WO2003008938 | A2 | 1/2003 |

* cited by examiner

SYSTEMS AND METHODS FOR THERMAL BARRIER COATINGS TO MODIFY ENGINE COMPONENT THERMAL CHARACTERISTICS

STATEMENT OF GOVERNMENT INTEREST

This invention was made with government support under contract DE-EE0008476 awarded by the DOE. The Government has certain rights in this invention.

TECHNICAL FIELD

The present disclosure relates generally to systems using thermal barrier coatings, and more particularly, to the use of thermal barrier coatings to modify thermal characteristics of engine components.

BACKGROUND

The components of an internal combustion engine often experience damage caused by the use of the engine. One example of the type of damage or wear that can occur is frictional damage (or frictional wear) caused by the movement of engine component surfaces against each other, such as the piston rings and inside cylinder wall of a cylinder. This relational movement cases surface damage to the components. To minimize frictional wear, in addition to smoothing the surfaces of the contacting components, liquid lubricants such as oil or coatings such as Teflon® are often used. These lubricants or coatings provide an interface whereby the damage to the engine components is reduced. The oil reduces the friction between moving component, helps cool the components, and remove contaminants.

Engine components can also be damaged due to excessive heat. As most components in a typical combustion engine are comprised of a metal or metal alloy, excessive heat can degrade the crystalline structure of these components. If the crystalline structure of the metal or metal alloy is degraded enough, the metal or alloy can become brittle and break. The damage to the metal or alloy crystalline structure can be caused in a single overheating event or over time. In some instances, even a typical engine operating temperature, not an overheating event, can initiate damage to some components. The damage to the crystalline structure is often irreversible, meaning that the engine component's structural integrity has degraded and will not improve, and more significantly, will likely continue to degrade over time and the continued operation of the engine.

Engine components can also be damaged due to the differential heat across the component itself or proximate components. As discussed herein, "differential heat" describes a condition in which one location of the component (or proximate component) has a different temperature than another location of the component (or proximate component). Different (or differential) temperatures can cause damage for various reasons. For example, different temperatures within the same component can cause microscopic stress fractures caused by an uneven expansion of material. These stress fractures in the crystalline lattice of the metal increase in number and size as the component is used, potentially leading to an eventual failure of the component.

A mechanism for carbon capture is described in Japanese Publication No. JP20005337180A (hereinafter referred to as "the '180 reference"). In particular, the '180 reference describes a system directed toward mitigating the potential wear on engine components caused by excessive engine temperatures. The system of the '180 reference describes the use of thermal barrier coatings to coat components of a turbine engine. The thermal barrier coating is tested for structural integrity under the temperature conditions found in the turbine engine. However, the disclosure of the '180 reference discloses issues with the thermal barrier coatings themselves, not the components to which the thermal barrier coatings are applied. Thus, the system described in the '180 reference is still prone to component wear and possible damage caused by, for example, the differential heat across the component itself or proximate components.

Examples of the present disclosure are directed to overcoming deficiencies of such systems.

SUMMARY

In one aspect of the present disclosure, an engine component includes a surface, a first area of the surface having a first rate of temperature change, a second area of the surface having a second rate of temperature change, wherein the second rate of temperature change is lower than the first rate of temperature change, and a first coating of a thermal barrier coating applied to the first area, the first coating configured to reduce a rate of heat transfer into and out of the first area to reduce a difference of a rate of temperature change between the second area and the first area.

In another aspect of the present disclosure, a method of modifying an engine component includes identifying an engine component for thermal characteristic modification, determining a thermal map across a surface of the engine component, and applying a first coating of a thermal barrier coating to the surface to reduce a temperature difference between a first area of the surface and a second area of the surface.

In a still further aspect of the present disclosure, a valve for use in an internal combustion engine includes a stem, a head that transitions from the stem, the head comprising a surface that receives a portion of heat generated during a combustion of a fuel, wherein the surface comprises a first area having a first rate of temperature change and a second area having a second rate of temperature change, wherein the second rate of temperature change is lower than the first rate of temperature change, and a first coating of a thermal barrier coating applied to the first area, the first coating configured to reduce a rate of heat transfer into and out of the first area to reduce a difference of a rate of temperature change between the second area and the first area.

DETAILED DESCRIPTION

Technologies described below are directed to systems and methods for using thermal barrier coatings to modify engine component thermal characteristics. Wherever possible, the same reference numbers will be used throughout the drawings to refer to the same or like parts.

Figure 1:
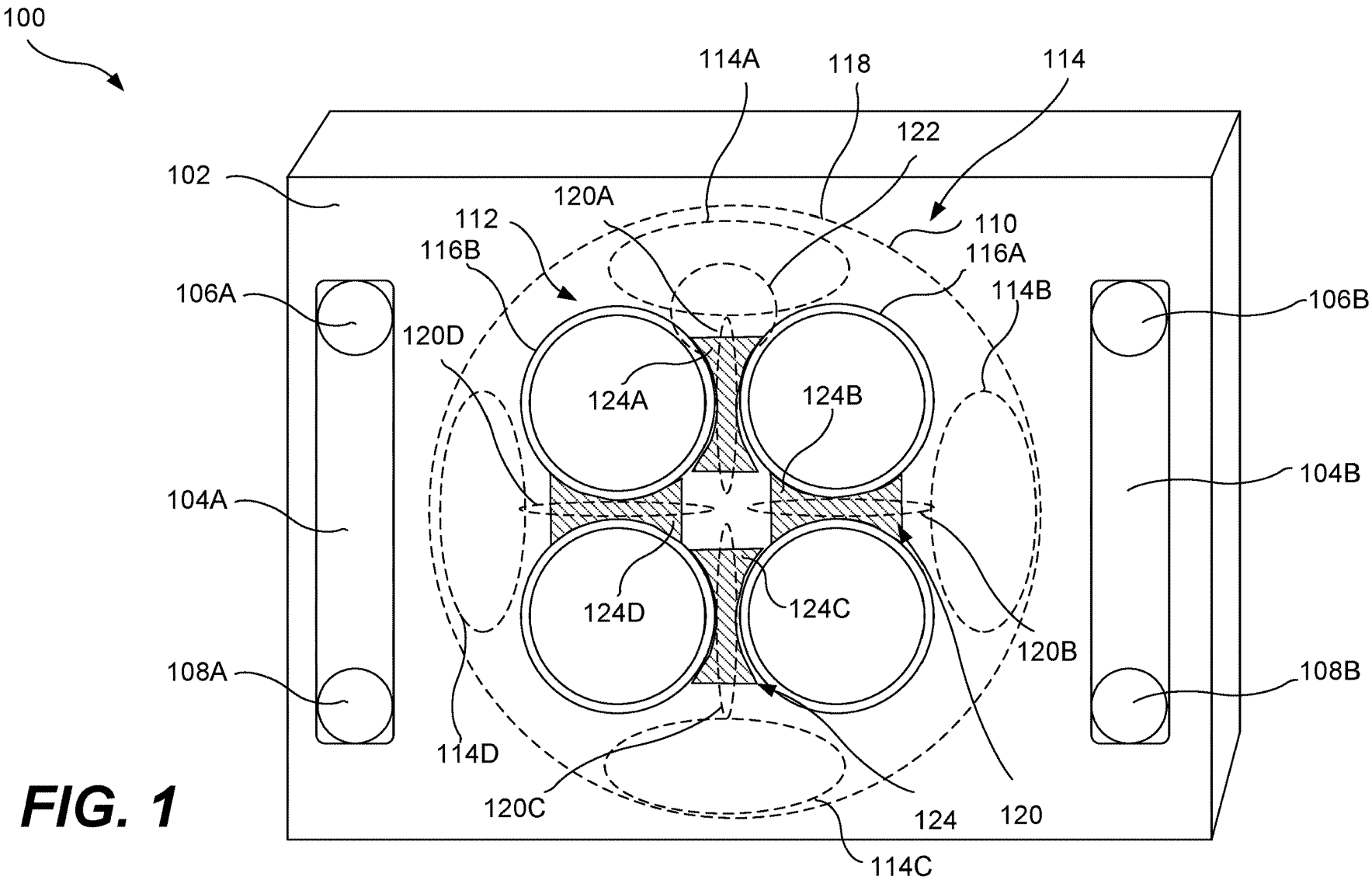
FIG. 1 illustrates a cylinder head using a thermal barrier coating to modify one or more thermal characteristics of the cylinder head, in accordance with examples of the presently disclosed subject matter.

FIG. 1 illustrates a cylinder head 100 on which a thermal barrier coating has been applied to modify one or more thermal characteristics of the cylinder head 100, in accordance with examples of the presently disclosed subject matter. The cylinder head 100 is used as a component in an internal combustion engine (not shown). The cylinder head 100 has a mating surface 102 that mates with and/or is otherwise used to attach the cylinder head 100 to an engine (or cylinder) block (not shown) of an engine. Typically, the cylinder head 100 is attached to the engine block with one or more gaskets (not shown) providing a seal between the cylinder head 100 and the engine block (not shown), though the presently disclosed subject matter is not limited to the use of gaskets. Further, the presently disclosed subject matter is not limited to a removable cylinder head 100, whereby the cylinder head 100 may be attached and detached from an engine block. The cylinder head 100 includes coolant channels 104A and 104B that allow engine coolant to move through the cylinder head 100, and into and from the engine block. Coolant is pumped into the coolant channels 104A and 104B through coolant inlets 106A and 106B, respectively. Coolant is pumped from the coolant channels 104A and 104B through coolant outlets 108A and 108B, respectively.

The cylinder head 100 includes chamber interface section 110. When mated to a cylinder of an engine block, the volume between a piston of the engine block and the chamber interface section 110 forms a combustion chamber whereby fuel is combusted by the combustion engine. The chamber interface section 110 includes a bowl 112, sometimes referred to as a "firedeck," that provides an enclosed space for gases compressed by the cylinder near the end of the compression stroke (or top dead center) to ignite. The expanding gases resulting from the ignition of the fuel force a piston, during a power stroke, to move or rotate a component, typically a crankshaft if the engine is used for motive power. However, it should be noted that the pistons can also move or turn other components in different engine types such as a shaft for power generation. The presently disclosed subject matter is not limited to any particular use for a compression engine. Further, the presently disclosed subject matter is not limited to any type of fuel, such as gasoline or diesel engines. Additionally, the presently disclosed subject matter is not limited to any specific compression cycle, as two or four stroke cycle engines, as well as other internal combustion engine types, are considered to be within the scope of the presently disclosed subject matter.

As discussed above, in some operating conditions engine components can be damaged due to the differential heat across the component itself or components proximate to the engine component, wherein one location or area of the component (or proximate component) has a different temperature than another location of the component (or proximate component). Differential heat can be caused by numerous factors, including different rates of change of temperature. For example, if a part (or area) of a component heats up faster (or cools down faster) than an adjacent or proximate area of the component, the difference in the rate of change of temperature between the two (or more) parts of the component can cause a differential temperature across the component. This differential temperature can cause one part of the component to expand and contract at a different rate and degree than the other part, thus potentially introducing structural defects in the crystalline lattice of the component.

The differential rate of temperature change can be caused by various factors, including a location (i.e., whether or not the component or part of the component is close to or far away from a combustion chamber or a proximity to a cooling source), the size of the area, the alloying of the components, and the like. For example, in FIG. 1, the bowl 112 of the chamber interface section 110 of the cylinder head 100 has various areas that are exposed to the heat caused by combustion and cooling provided by an intake of relatively cooler gases, including a fuel. In FIG. 1, the bowl 112 includes lobes 114A-114D (referred to herein generally as "the lobes 114" and individually as "the lobe 114A," "the lobe 114B," and the like). The lobes 114 are generally the area (or volume of material) of the bowl 112 proximate to and between a valve seat, such as valve seat 116A, and a circumference 118 of the chamber interface section 110 for the lobe 114A. The bowl 112 further includes bridges 120A-120D (referred to herein generally as "the bridges 120" and individually as "the bridge 120A," "the bridge 120B," and the like) that are generally an area (or volume of material) between valve seats 116, such as the bridge 120A between the valve seat 116A and the valve seat 116B.

As illustrated in FIG. 1, the volume of material of the bridges 120 is smaller than the volume of material of the lobes 114, i.e., the lobes 114 are structurally larger in mass than the bridges 120. The lobes 114 having a relatively larger mass than the bridges results in the lobes 114 having a relatively higher heat capacity than the bridges 120. "Heat capacity" is a thermal property or characteristic defined as the amount of heat applied to an object to produce a unit change in its temperature. Having a higher heat capacity means that for the same amount of heat applied to both the lobes 114 and the bridges 120, the bridges 120 will have a higher temperature increase compared to the lobes 114. However, differential temperatures across a component may be caused by other effects. For example, the proximity or remoteness of an area of a component to a cooling (or heating) source compared to other areas may also cause differential temperatures (and therefore, different rates of expansion/contraction). For example, the regions formed by the bridges 120 have a more confined geometry that are distal from coolant channels due to the openings needed for valves. Thus, while the coolant channels 104A and 104B through coolant inlets 106A and 106B and coolant outlets 108A and 108B provide some measure of cooling to portions of the bowl 112, because of the location of the bridges 120 with respect to the coolant channels 104A and 104B, the magnitude or capacity to provide cooling to the bridges 120 is lower compared to regions closer to the coolant channels 104A and 104B, causing a cooling limitation that is combined with a difference in heat capacity between the bridges 120 and other structures illustrated in FIG. 1. Thus, varying cooling capacities and/or heat capacities, along with other thermal phenomena, may cause differential temperatures. The presently disclosed subject matter is not limited to any one particular reason for differential temperatures, as the following discussion of FIGS. 1-8 referencing heat capacities is provided as an example and not a limitation of the scope of the presently disclosed subject matter.

The different temperatures between the lobes 114 and the bridges 120 during heating and cooling can cause structural defects. These defects can result because the same metal will experience a higher degree of expansion at a higher temperature than at a lower temperature, and also, will experience a higher degree of contraction at a lower temperature than a higher temperature. Thus, because the different areas of the bowl 112, e.g., the lobes 114 and the bridges 120, can be at different temperatures as heat is applied and removed, the different areas will have different degrees of expansion and contraction. Materials such as metals typically expand and contract as the temperature of the materials change. The degree at which the material expands depends on the crystalline structure of the material, but in general, as metal is heated, the metal expands, and conversely, as the metal is cooled, the metal contracts. Therefore, for a given metal, the amount of expansion and contraction depends on the temperature change of the metal. In a steady state situation, whereby the entirety of a metallic component is at or about a single temperature, substantially all the areas of the component have expanded or contracted equally. However, in a non-steady state situation, whereby some areas of the component are at a different temperature than other areas of the component, the amount of expansion/contraction is substantially dependent on the temperature of that area.

To reduce or eliminate the difference in temperature between the lobes 114 and the bridges 120 to reduce the different degrees of expansion and/or contraction between the lobes 114 and the bridges 120, thermal barrier coating (TBC) 124A-124D (referred to herein generally as "the thermal barrier coating 124" and individually as "the thermal barrier coating 124A," "the thermal barrier coating 124B," and the like) is applied. A used herein, a "thermal barrier coating" comprises one or more materials that are bonded or applied to a surface, such as the bowl 112. A thermal barrier coating, due to its relatively lower thermal conductivity than the material to which the TBC 124 is bonded to, provides a degree of thermal insulation to the coated surfaces. The insulative properties of the TBC 124 reduces the rate at which heat is transferred into and out of the area to which the TBC is applied. This reduction in the rate of heat transfer can be used to compensate for the different rates of temperature change that may be found in a component, such as the bowl 112.

The TBC 124 can be constructed from various materials including, but not limited to, ceramics or alloys such as Zirconia, Nickel Chromium Aluminum Yttrium (NiCrAlY), Nickel Cobalt Chromium Aluminum Yttrium (NiCoCrAlY), Yttria Stabilized Zirconia (YSZ) and Ceria Stabilized Zirconia (CSZ). The presently disclosed subject matter is not limited to any particular material to be used for the TBC 124. Depending on the particular TBC 124, the thickness of the TBC 124 can range from less than 100 μm to 3000 μm. Further, the manner in which the TBC 124 is applied may vary from spraying, spin coating, plasma deposition, and the like. The presently disclosed subject matter is not limited to any particular manner of applying (or bonding) the TBC 124.

To compensate for different rates of temperature change, the TBC 124 is applied to areas in which a lower rate of temperature change is desired. In the example illustrated in FIG. 1, it is desirable to reduce the rate at which the bridges 120 increase or decrease in temperature relative to the lobes 114. The TBC 124 applied to the portions of the bridges 120 illustrated in FIG. 1 reduces the rate of heat transfer into (and out of) the bridges 120 because, as mentioned above, the TBC 124 adds a layer of insulation against the heat of combustion and the cooling effect of the fuel and incoming gases (such as air and fuel). Reducing or minimizing the difference of the rates of temperature change between the lobes 114 and the bridges 120 can reduce, minimize, or slow the creation of structural defects to areas, such as transitional area 122 between the lobes 114 and the bridges 120, as the transitional areas 122 will experienced the greatest degree of temperature difference between the lobes 114 and the bridges.

For example, the insulative properties of the TBC 124A reduces the rate at which the bridge 120A heats and cools to a rate closer to the rate at which the lobe 114A heats and cools. The TBC 124A compensates the relatively lower heat capacity of the bridge 120A to be thermally similar to the lobe 114A. By modifying the thermal characteristics without making structural changes to the bridge 120A, the structural nature (such as strength, size, width, and the like) of the lobe 114A and the bridge 120A that are designed in a way to perform their respective functions during the operation of the engine are left unaltered.

Different temperatures in areas of a component can be caused by various reasons including, but not limited to, the location of the area of the component in relation to a heat source, the amount of mass of the area, and the like. As noted above, the TBC 124 may be deposited in various thicknesses, shapes, patterns, and the like to create desired thermal characteristics while maintaining the structural nature of the component. An example of using the TBC 124 to compensate for different masses of areas of the bowl 112 was illustrated in FIG. 1. A varying thickness application of the TBC 124 is illustrated in FIG. 2.

Figure 2:
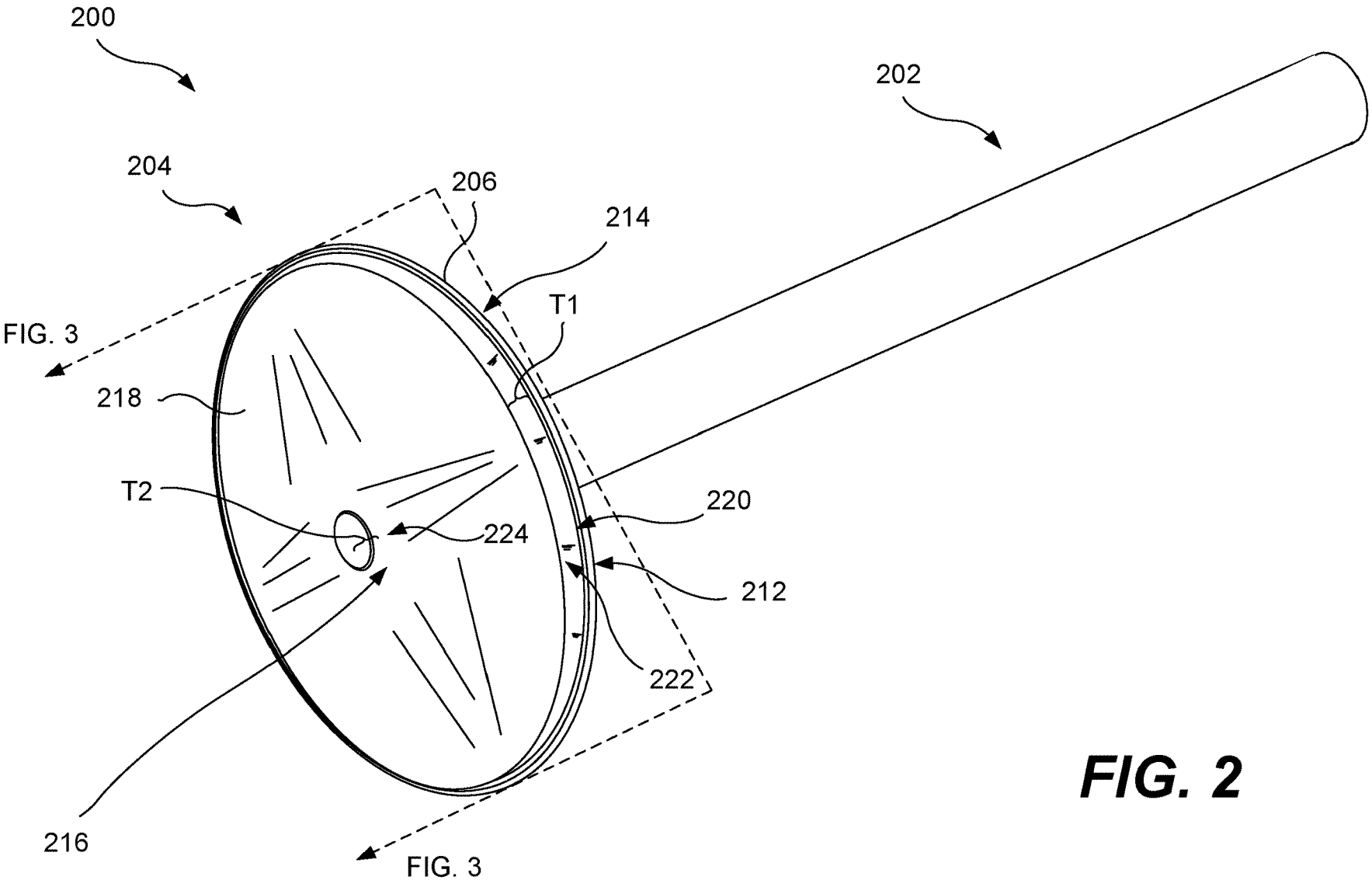
FIG. 2 is an elevation view of a valve that may be used in conjunction with a cylinder head using a thermal barrier coating, in accordance with examples of the presently disclosed subject matter.

FIG. 2 is a side view of a valve 200 that may be used in conjunction with the cylinder head 100 of FIG. 1, illustrating a thermal barrier coating of varying thickness, in accordance with examples of the presently disclosed subject matter. The valve 200 has a stem 202 that transitions to a head 204. The head 204 includes a valve seat 206 that, when sealed against a valve seat 116 of FIG. 1, creates a seal that allows for the compression of gas for combustion. The portion of the head 204 is the portion of the valve 200 that is within a combustion chamber (not shown) of an internal combustion engine. When the fuel combusts, heat from combustion gases causes the rapid expansion of the combusted gases. A portion of the heat enters the head 204 of the valve 200.

As shown in FIG. 2, the valve 200 is formed from a material, like a metal, ceramics, or alloys thereof, with varying thicknesses, shapes, and the like. These varying thicknesses, shapes, and the like can affect the rate at which a particular portion of the valve 200 heats up and cools down in relation to other portions of the valve 200. For example, valve area 212 is illustrated in FIG. 2 as an area that is located proximate to an outer surface 214 of the head 204 and valve area 216 is illustrated in FIG. 2 as an area of the valve 200 close to a central part of the head 204. As will be shown in more detail in FIG. 3, there may be various processes that determine which portions of a component heat up (or cool down) at a greater rate than other portions. For example, while the valve area 212 has a relatively lower mass of material when compared to the valve area 216, the valve area 216 can heat up at a greater rate than the valve area 212. Thus, when compared to the valve area 212, the valve area 216 has a higher rate of temperature change than the valve area 212, which has a lower rate of temperature change. The reason for that is that even though the valve area 216 may have a higher heat capacity than the valve area 212 (due to the relatively larger mass), heat transferred into the valve area 212 may be removed from the valve area 212 through the contact of a valve seat, having a relatively lower temperature, with the valve area 212, giving the valve area 212 a relatively larger heat conduction path than the valve area 216. The different rates of temperature increase for the same or similar amount of heat input can cause the valve area 212 to expand at a different rate than the valve area 216, potentially causing structural defects within the head 204 and the valve 200.

To reduce the different rates of temperature change, the valve area 212 and the valve area 216 can be modified using a TBC 218. As noted above with respect to FIG. 1, a TBC 218 acts as an insulative layer, reducing the rate of heat transfer into the areas coated by the TBC 218 at a rate determined by the thickness of the TBC 218. For example, a thicker layer of the TBC 218 will reduce a rate of heat transfer into the head 204 to a rate lower than a relatively thinner layer of the TBC 218. FIG. 2 illustrates this as a means to reduce the different heat capacities of the various areas of the valve 200. In the example illustrated in FIG. 2, the TBC 218 has a thickness T1 proximate to the outer surface 214 of the head 204 as measured from an exterior surface 220 of the head 204 to an exterior surface 222 of the TBC 218. The TBC 218 further has a thickness T2 proximate to the valve area 216 as measured from the exterior surface 220 of the head 204 to an exterior surface 224 of the TBC 218. The thickness T1 proximate to the outer surface 214 of the head 204 provides for a first heat transfer rate through the TBC 218 that is higher than the relatively greater thickness T2 proximate to the valve area 216, allowing for a lower rate of heat input into the valve area 216 relative to the outer surface 214 of the head 204. Thus, the lower heat transfer rate through thickness T2 reduces the rate of temperature change of the valve area 216 to be closer to the rate of temperature change of the valve area 212, thereby reducing the difference of expansion rates between the outer surface 214 of the head 204 and the valve area 216. Further, in some examples in which a reduction in a temperature differential results in a lower operating temperature of a part of a component, reducing the temperate can also reduce defects caused by temperature itself, thereby increasing fatigue strength and the life of the component.

Figure 3:
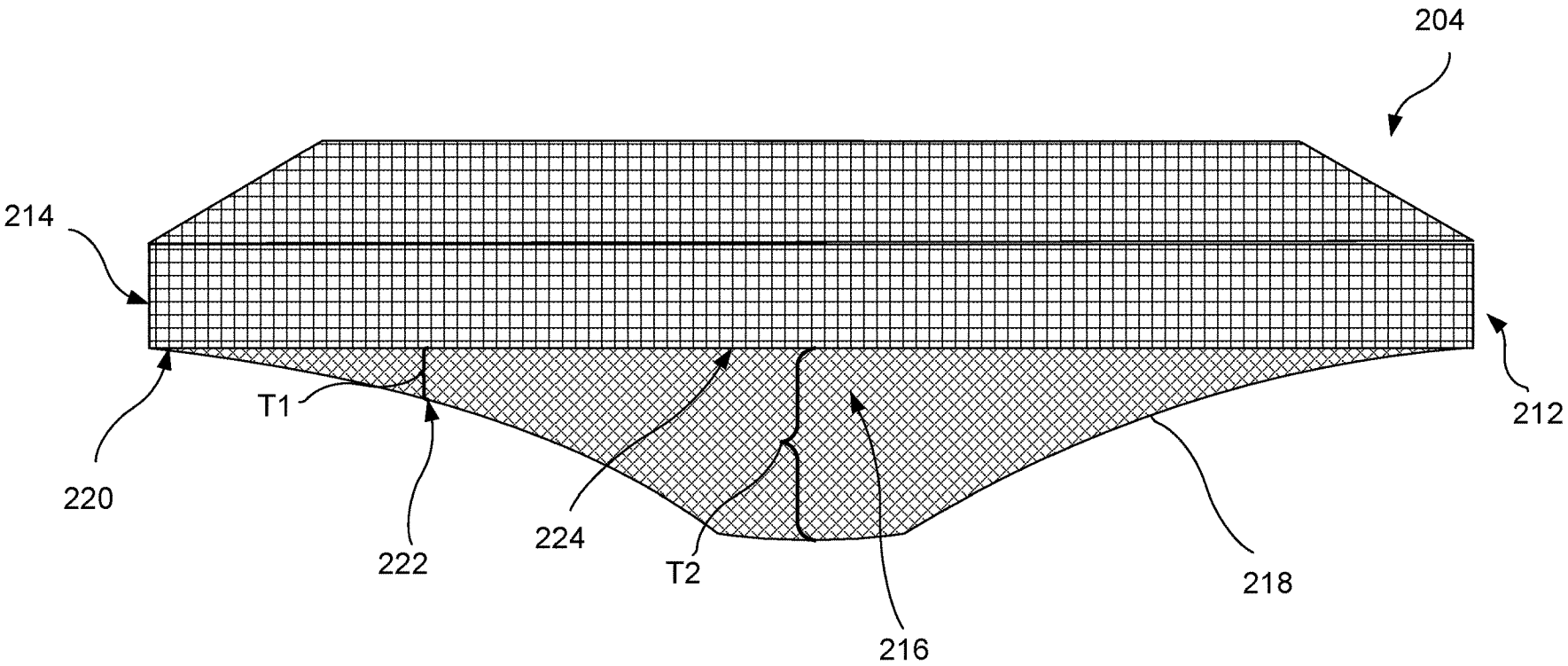
FIG. 3 is a cross-sectional view of a valve head using a thermal barrier coating with varying thickness, in accordance with examples of the presently disclosed subject matter.

FIG. 3 is a cross-sectional view of the head 204 of the valve 200 showing the varying thickness of the TBC 218 across the exterior surface 224 of the head 204, in accordance with examples of the presently disclosed subject matter. As shown in FIG. 3, the TBC 218 has a thickness T1 proximate to the outer surface 214 of the head 204 as measured from an exterior surface 220 of the head 204 to an exterior surface 222 of the TBC 218. The TBC 218 further has a thickness T2 proximate to the valve area 216 as measured from the exterior surface 220 of the head 204 to an exterior surface 224 of the TBC 218. The thickness T1 proximate to the outer surface 214 of the head 204 provides for a first heat transfer rate through the TBC 218 that is greater than the relatively larger thickness T2 proximate to the valve area 216, allowing for a lower rate of heat input into the valve area 216 relative to the outer surface 214 of the head 204. Thus, while the heat capacity of the valve area 216 may be lower than the heat capacity of the outer surface 214 of the head 204, because there is a higher rate of heat transfer from the valve area 212, explained in FIG. 2 above, the lower heat transfer rate through thickness T2 reduces the rate of temperature change of the valve area 216 to be closer to the rate of temperature change of the valve area 212.

FIGS. 2 and 3 illustrate a single coating of the TBC 218 with varying thicknesses to adjust for the rate of heat transfer into different areas of the valve 200. For example, in areas with a lower heat capacity, meaning the area absorbs a relatively smaller amount of heat for a given temperature change as compared to an area with a higher heat capacity, a relatively thicker layer of the TBC 218 can be used to reduce the rate of heat transfer into the area with the lower heat capacity. However, the TBC 218 may use various patterns to achieve normalization of rates of temperature increase/decrease in a component, illustrated by way of example in FIG. 4, below.

Figure 4:
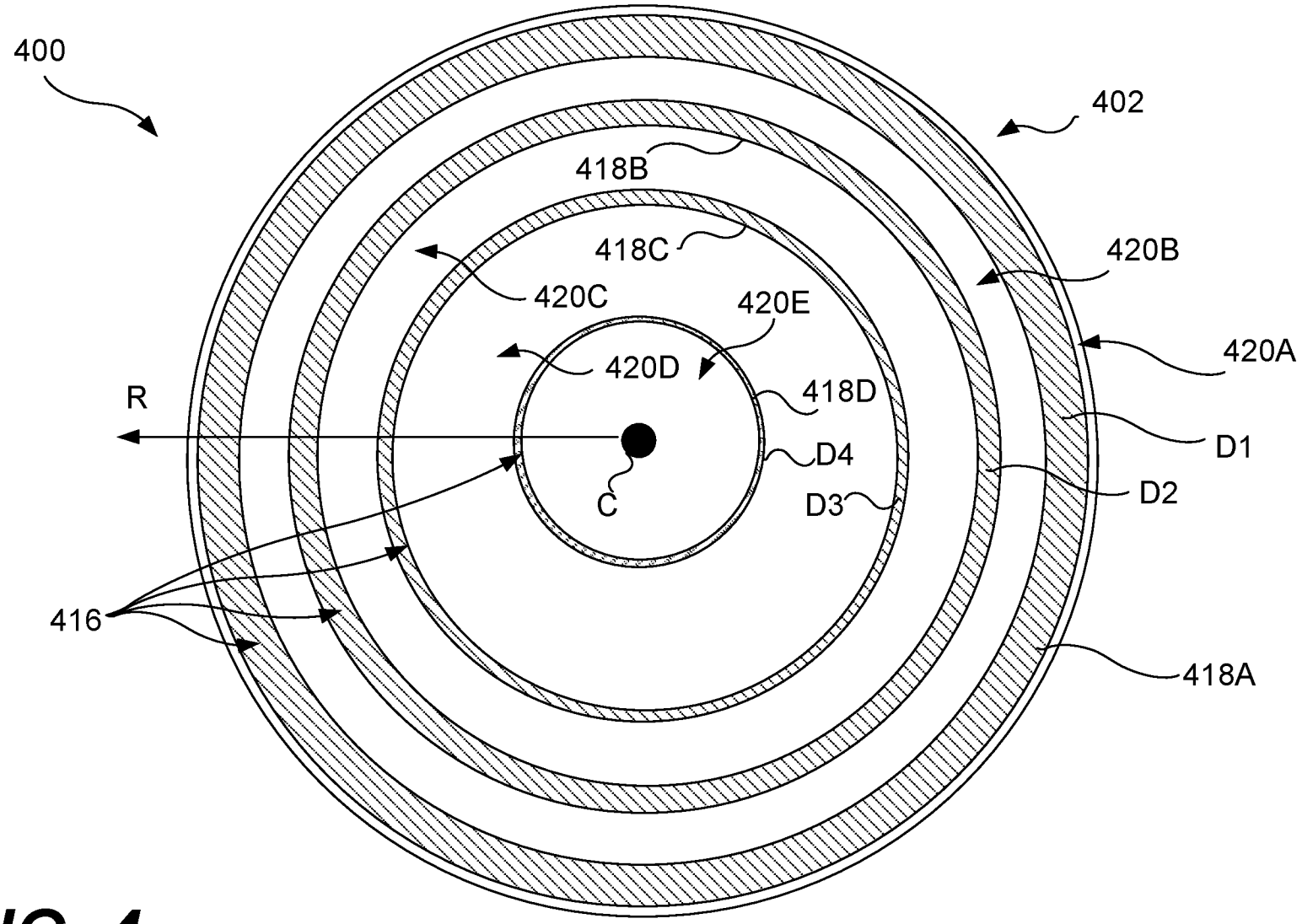
FIG. 4 illustrates an exterior surface of a valve having a thermal barrier coating with multiple concentric rings, in accordance with examples of the presently disclosed subject matter.

FIG. 4 illustrates an exterior surface 402 of a valve 400 having a thermal barrier coating with multiple concentric rings, in accordance with examples of the presently disclosed subject matter. Shown in FIG. 4 is the exterior surface 402, which is the area of the valve 400 that is exposed to the heat from the combustion of gases in an internal combustion engine. The valve 400 also includes the TBC 416, applied as concentric rings around a center C of the exterior surface 402, with each ring of the TBC 416 having various diameters. In the example illustrated in FIG. 4, the center C experiences the lowest rate of temperature change, though the presently disclosed subject matter of the following figures may also be used in the examples described in FIGS. 1-3, above. Illustrated are concentric TBC 418A with diameter D1, concentric TBC 418B with diameter D2, concentric TBC 418C with diameter D3, and concentric TBC 418D with diameter D4. Uncoated areas of the exterior surface 402 are illustrated as areas 420A-420E. In the example illustrated in FIG. 3, the diameter D1 of the concentric TBC 218A is greater than the diameter D2 of the concentric TBC 218B. The diameter D2 of the concentric TBC 218B is greater than the diameter D3 of the concentric TBC 218C. The diameter D3 of the concentric TBC 218C is greater than the diameter D4 of the concentric TBC 218D.

Thus, rather than being deposited as a single layer, potentially with varying thicknesses as illustrated in FIG. 2, a thermal barrier coating, such as the TBC 416 of FIG. 4 is deposited using concentric rings. The location and diameter of the concentric rings, such the concentric TBC 218A-218D of FIG. 4, are adjusted to modify expansion and contraction rates of the various areas of the valve 400. For example, rate of heat transfer into the area 420B, which is illustrated as being uncoated, is not modified whereas the areas of the exterior surface 402 coated with the TBC 416 have reduced rates of heat transfer into and out of those areas, reducing their rate of expansion and contraction.

In addition to using patterns of the TBC to adjust the thermal characteristics of a specific area, TBCs can be deposited in various patterns to achieve other benefits such as TBC crack control. Because TBCs are often formed from very strong but brittle alloys or ceramics, structural defects can occur in the TBCs themselves. These structural defects can result in cracks in the TBC material. As the TBCs are thermally cycled (i.e., heated up and cooled down), these cracks can propagate through the TBC. Other means may be used to control cracks including, but not limited to, concentric rings divided into parts (arcs) or other shapes broken into individual parts. However, using various patterns, the TBC can not only be used to provide the thermal characteristics desired for engine components, but also, provide structural advantages to the TBCs themselves, illustrated by way of example in FIG. 5.

Figure 5:
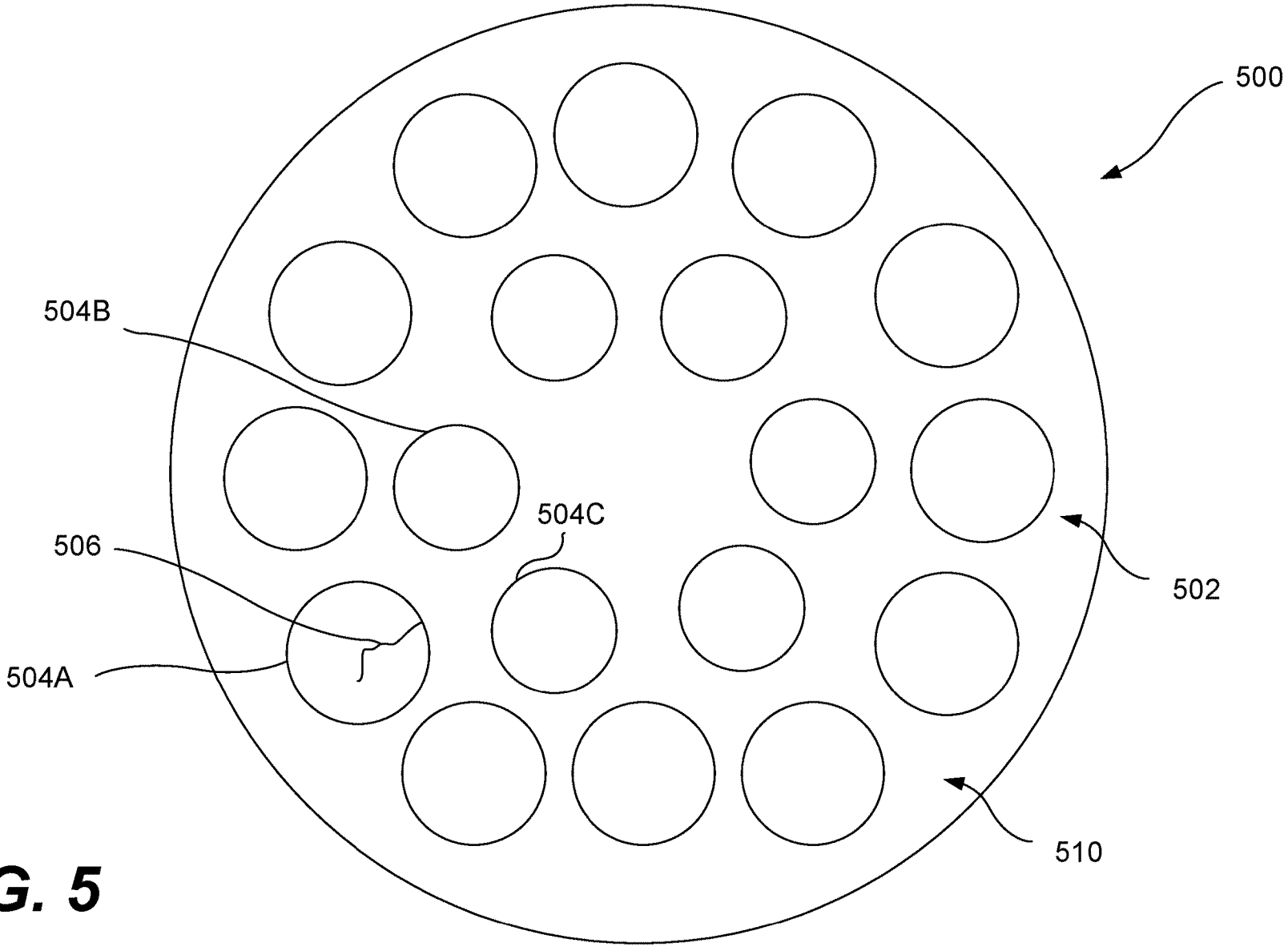
FIG. 5 illustrates a surface of a valve on which a thermal barrier coating has been applied in a pattern, in accordance with another example of the presently disclosed subject matter.

FIG. 5 illustrates a valve 500 using a thermal barrier coating in a pattern to reduce crack propagation, in accordance with examples of the presently disclosed subject matter. Shown in FIG. 5 is exterior surface 510, which is the area of the valve 500 that is exposed to combustion heat. In the example illustrated in FIG. 5, the valve includes TBC 502. The TBC 502 is formed from multiple TBC coatings, such as TBC coating 504A and TBC coating 504B, creating a "dot matrix" pattern. In the configuration illustrated in FIG. 5, structural issues in one of the TBC coatings can be isolated to that particular TBC coating rather than affecting the entire TBC itself.

For example, if TBC coating 504A develops a crack 506, the distance between the TBC coating 504A and adjacent TBC coatings allows for the crack 506 to only affect and propagate through the TBC 504A rather than affect surrounding or adjacent TBC coatings, such as TBC coating 504C. If the TBC 502 were deposited as a single, monolithic layer, cracks and other structural defects occurring in one location of the TBC 502 can affect other locations of the TBC 502. However, using broken patterns, such as the dot matrix pattern of FIG. 5, cracks in one TBC coating can be isolated to that particular TBC coating and not affect the other TBC coatings. In some instances, it may be desirable to have a coating that provides similar benefits to a monolithic layer, while still providing the benefits of a patterned coating, illustrated by way of example in FIG. 6.

Figure 6:
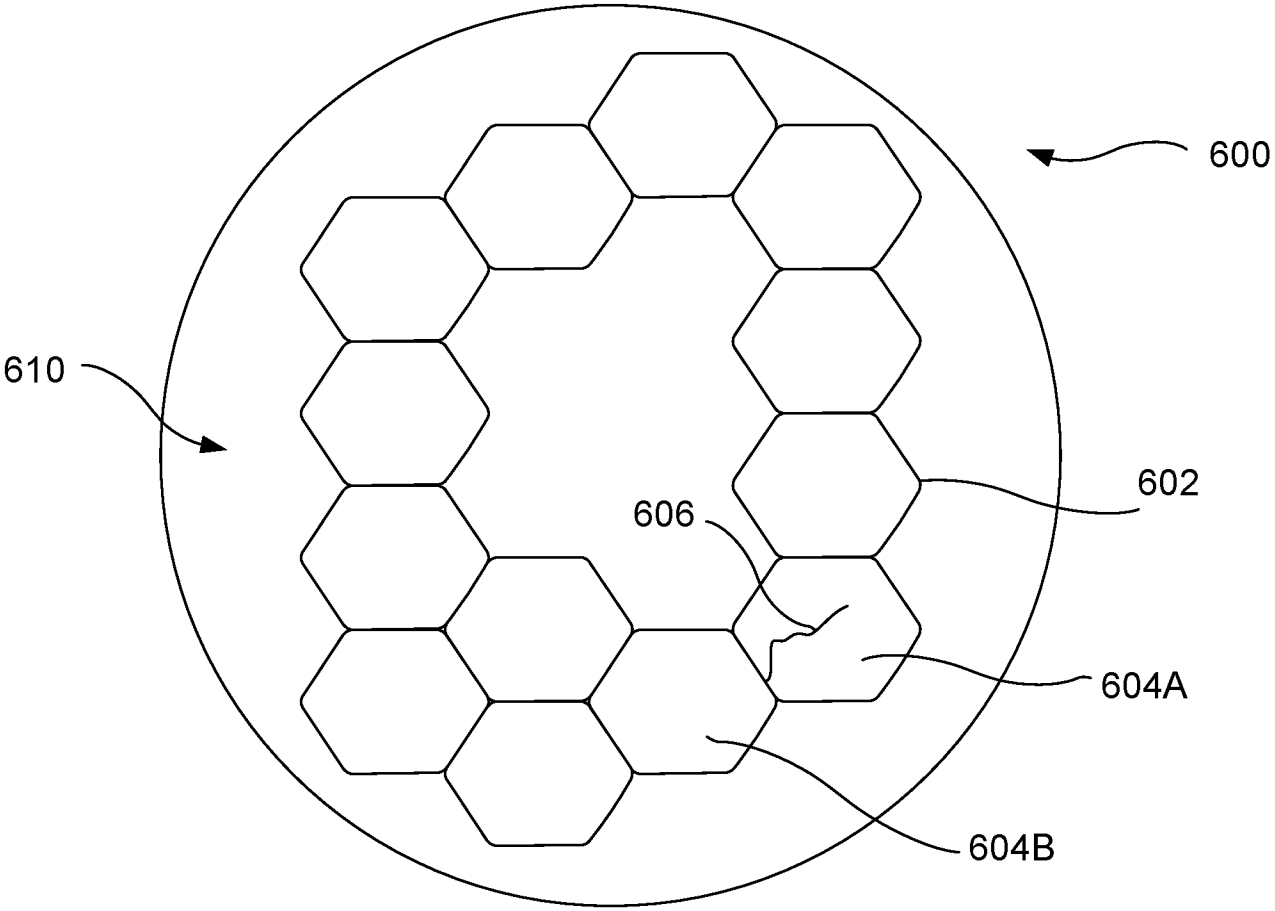
FIG. 6 illustrates a surface of a valve on which a thermal barrier coating has been applied in a near monolithic pattern, in accordance with a further example of the presently disclosed subject matter.

FIG. 6 illustrates a valve 600 using a pattern to provide a near monolithic deposition of the thermal barrier coating while providing for crack isolation, in accordance with examples of the presently disclosed subject matter. Shown in FIG. 6 is exterior surface 610, which is the area of the valve 600 that is exposed to combustion heat. In the example illustrated in FIG. 6, the valve includes TBC 602. The TBC 602 is formed from multiple TBC coatings, such as TBC coating 604A and TBC coating 604B. However, unlike the "dot matrix" pattern of FIG. 5, the TBC coatings, such as the TBC coating 604A and the TBC coating 604B are formed using hexagonal (or honeycombed shaped) coatings. In this manner, space between the TBC coatings can be minimized, forming a coating that is close to and closely functions like a monolithic layer. However, because each TBC coating is separately deposited, structural defects in one TBC coating can be isolated to that TBC coating. For example, if the TBC coating 604A develops a crack 606, the crack 606 only affects and propagates through the TBC coating 604A rather than affecting surrounding TBC coatings, such as the TBC coating 604B.

Figure 7:
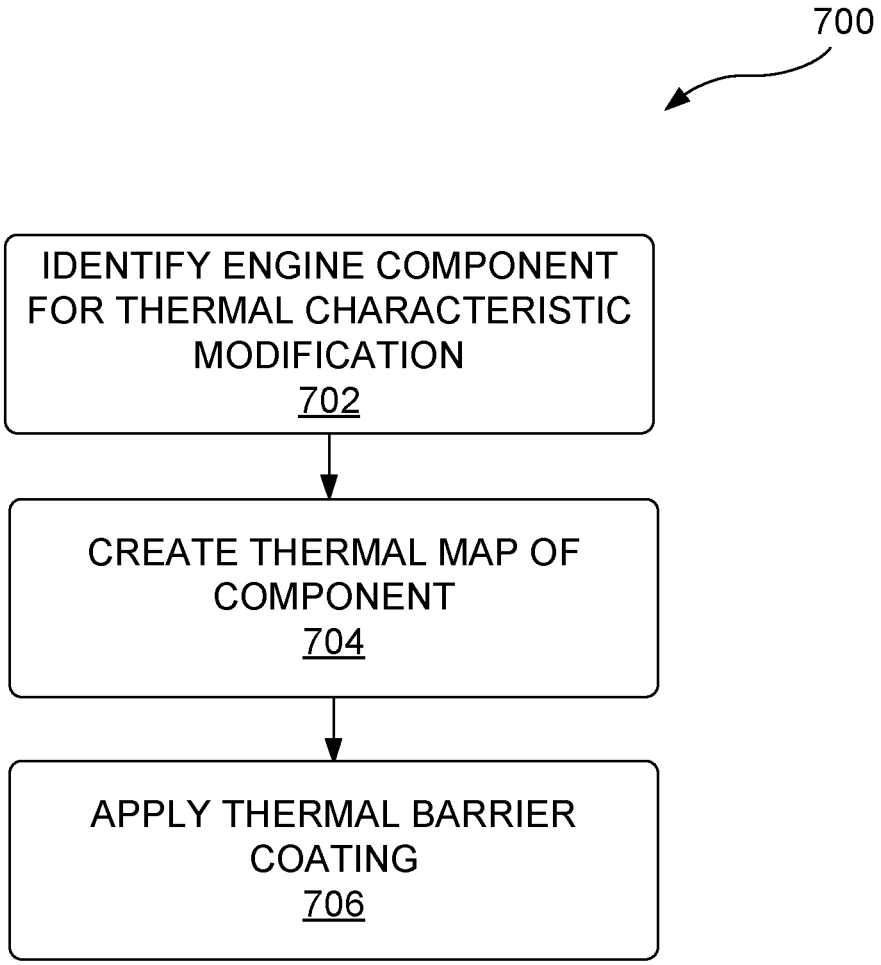
FIG. 7 is a flowchart illustrating a method of modifying the thermal characteristics of an engine component using thermal barrier coatings, in accordance with examples of the presently disclosed subject matter.

FIG. 7 is a flowchart illustrating a method 700 of modifying the thermal characteristics of an engine component using thermal barrier coatings, in accordance with examples of the presently disclosed subject matter. The method 700 may include different and/or additional steps, or steps may be performed in a different order than described herein.

At step 702, an engine component is identified for thermal characteristic modification. In FIG. 1, parts of the cylinder head 100 were modified, specifically, the bridges 120. In FIGS. 2-4, a valve 200 and 400, is illustrated as being modified. However, it should be noted that the presently disclosed subject matter is not limited to any particular engine component.

Figure 8:
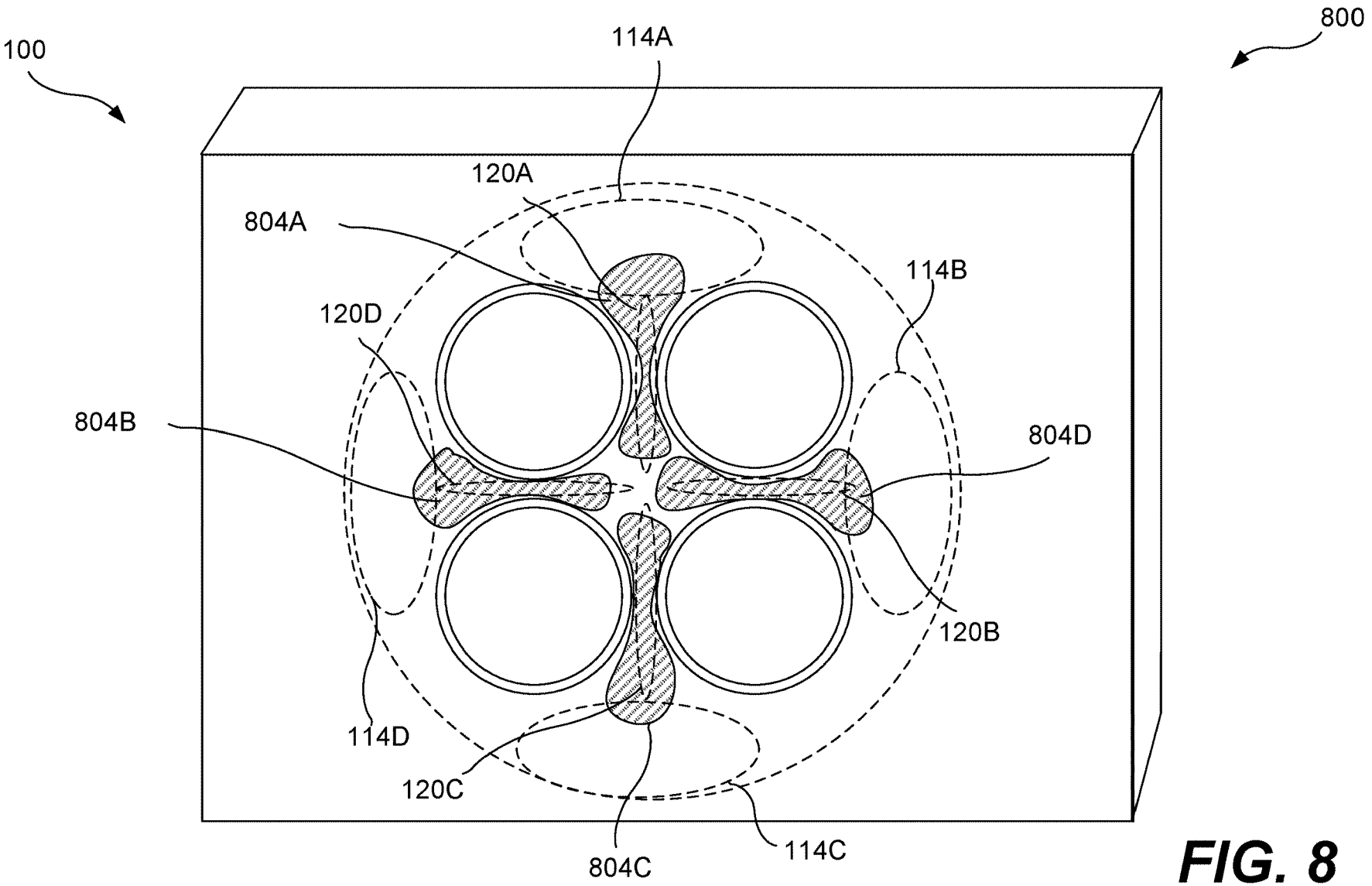
FIG. 8 is an example of a thermal map used to determine the application of a thermal barrier coating, in accordance with examples of the presently disclosed subject matter.

At step 704, a thermal map is created. A thermal map illustrates temperature differences across a surface. FIG. 8 is an example of a thermal map 800 of the temperatures across the cylinder head 100 of FIG. 1, in accordance with examples of the presently disclosed subject matter. In FIG. 8, temperatures across the cylinder head 100 of FIG. 1 have been calculated or measured and are graphically illustrated. For example, thermal signatures 804A-804D indicate that the bridges 120 (as illustrated in FIG. 1) are at a higher temperature than the lobes 114.

At step 706, using the thermal map 800, a thermal barrier coating 124 is applied. The TBC 124 can be constructed from various materials including, but not limited to, ceramics or alloys such as Zirconia, Nickel Chromium Aluminum Yttrium (NiCrAlY), Nickel Cobalt Chromium Aluminum Yttrium (NiCoCrAlY), Yttria Stabilized Zirconia (YSZ), or Ceria Stabilized Zirconia (CSZ). The presently disclosed subject matter is not limited to any particular material to be used for the TBC 124. Depending on the particular TBC 124, the thickness of the TBC 124 can range from less than 100 μm to 3000 μm. Further, the manner in which the TBC 124 is applied may vary from spraying, spin coating, plasma deposition, and the like.

Further, the TBC can be applied using various patterns to isolate issues with the TBC to certain areas while providing the desired thermal characteristics. For example, the TBC 218 of FIG. 3 uses concentric circles having the same or varying thickness. The TBC 416 of FIG. 4 is applied using a "dot matrix" pattern of TBC coatings. The TBC 502 of FIG. 2 is applied using hexagonal shapes to provide a more even coating of the TBC 502 while also isolating structure defects to a particular coating, such as the TBC coating 504.

INDUSTRIAL APPLICABILITY

The systems and methods described herein, and variations thereof, provide a means to reduce the potential for structural issues in engine components by reducing or minimizing the magnitude of temperature changes across the components. During use, engine components can experience a significant rise and fall in the amount of heat applied to the component. This rise and fall of heat results in a temperature increase and decrease. Because engine components are often shaped with varying sizes, volumes, and areas within the component itself, rates of temperature change can be different. If the difference of the rate of change of temperature is significant enough between two proximate areas of the component, structural damage to the crystalline lattice of the component can occur.

Thermal barrier coatings are applied to surfaces of components to reduce or eliminate the probability of damage due to the heating and cooling of the component. When a component heats or cools, different areas of the component can heat up or cool down at different rates due to various heat capacities of the areas of the component. The different temperatures (and rates of temperature changes) results in different rates of expansion and contraction within the component itself. To reduce the differences of temperature within the component, a thermal barrier coating is applied. The thermal barrier coating acts as a thermal insulator. Due to its insulative properties, the thermal barrier coating reduces the rate of heat transfer into and out of the area to which the thermal barrier coating is applied. Thus, for an area that has a tendency to heat relatively quickly as compared to an area that tends to heat (or cool) relatively slower, the thermal barrier coating slows the rate of temperature increase to be closer to the slower heating (cooling) area, thus minimizing the difference of temperatures of the engine component. Minimizing the difference of temperatures within a component minimizes the differences in expansion and contraction within the component, reducing the potential for stress fractures caused by an uneven expansion of material. This can reduce failures of the component due to structural issues, thereby allowing the component to be used for a longer time.

Unless explicitly excluded, the use of the singular to describe a component, structure, or operation does not exclude the use of plural such components, structures, or operations or their equivalents. As used herein, the word "or" refers to any possible permutation of a set of items. For example, the phrase "A, B, or C" refers to at least one of A, B, C, or any combination thereof, such as any of: A; B; C; A and B; A and C; B and C; A, B, and C; or multiple of any item such as A and A; B, B, and C; A, A, B, C, and C; etc.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated. While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A component of an internal combustion engine, the component comprising:

a surface positioned within the internal combustion engine;

a first area of the surface having a first rate of temperature change;

a second area of the surface having a second rate of temperature change, wherein the second rate of temperature change is lower than the first rate of temperature change; and a first coating of a thermal barrier coating applied to the first area, the first coating configured to reduce a rate of heat transfer into and out of the first area, and to reduce a difference of a rate of temperature change between the second area and the first area; and wherein the first coating comprises a plurality of thermal barrier coatings, wherein each of the plurality of thermal barrier coatings has at least a space between the plurality of thermal barrier coatings and an adjacent thermal barrier coating of the plurality of thermal barrier coatings.

2. The component of the internal combustion engine of claim 1, wherein the surface forms at least a part of a combustion chamber of the internal combustion engine.

3. The component of the internal combustion engine of claim 1, further comprising a second coating applied to the second area of the surface, wherein the first coating comprises a first width and the second coating comprises a second width.

4. The component of the internal combustion engine of claim 1, further comprising a second coating applied to the second area of the surface, wherein the first coating comprises a first thickness and the second coating comprises a second thickness.

5. The component of the internal combustion engine of claim 1, wherein the first coating comprises a first concentric ring around a central part of the engine component.

6. The component of the internal combustion engine of claim 5, further comprising a second coating on the surface of the engine component, the second coating comprising a second concentric ring around the central part of the engine component, wherein the first concentric ring has a greater diameter than the second concentric ring.

7. The component of the internal combustion engine of claim 1, wherein the first coating comprises a plurality of thermal barrier coatings having a hexagonal shape, wherein each of the plurality of thermal barrier coatings has at least a space between the plurality of thermal barrier coatings and an adjacent thermal barrier coating of the plurality of thermal barrier coatings.

8. A method of modifying a component of an internal combustion engine, the method comprising:

identifying the component of the internal combustion engine for thermal characteristic modification;

determining a thermal map across a surface of the component, the surface comprising a first area and a second area; and applying a first coating of a thermal barrier coating to the first area of the surface to reduce a temperature difference between a first area of the surface and a second area of the surface.

9. The method of claim 8, wherein the second area is free from the thermal barrier coating.

10. The method of claim 8, wherein the engine component is a cylinder head.

11. The method of claim 8, wherein applying the first coating comprises applying a first concentric ring of the thermal barrier coating around a central part of the component of the internal combustion engine.

12. The method of claim 11, further comprising applying a second coating of the thermal barrier coating to the second area of the surface of the engine component, the second coating comprising a second concentric ring around the central part of the component of the internal combustion engine, wherein the first concentric ring has a greater radius than the second concentric ring.

13. The method of claim 8, wherein the first coating comprises a plurality of thermal barrier coatings, wherein each of the plurality of thermal barrier coatings has at least a space between the plurality of thermal barrier coatings and an adjacent thermal barrier coating of the plurality of thermal barrier coatings.

14. The method of claim 8, wherein the first coating comprises a plurality of thermal barrier coatings having a hexagonal shape, wherein each of the plurality of thermal barrier coatings has at least a space between the plurality of thermal barrier coatings and an adjacent thermal barrier coating of the plurality of thermal barrier coatings.

15. A valve for use in an internal combustion engine, the valve comprising:

a stem;

a head that transitions from the stem, the head comprising a surface that receives a portion of heat generated during a combustion of a fuel, wherein the surface comprises a first area having a first rate of temperature change and a second area having a second rate of temperature change, wherein the second rate of temperature change is lower than the first rate of temperature change; and a first coating of a thermal barrier coating applied to the first area, the first coating configured to reduce a rate of heat transfer into and out of the first area in order to reduce a difference of a rate of temperature change between the second area and the first area.

16. The valve of claim 15, wherein the first coating comprises Zirconia, Nickel Chromium Aluminum Yttrium (NiCrAlY), Nickel Cobalt Chromium Aluminum Yttrium (NiCoCrAlY), Yttria Stabilized Zirconia (YSZ), or Ceria Stabilized Zirconia (CSZ).

17. The valve of claim 15, further comprising a second coating of the thermal barrier coating applied to the surface, wherein the first coating comprises a first width and the second coating comprises a second width.

18. The valve of claim 15, further comprising a second coating of the thermal barrier coating applied to the surface, wherein the first coating comprises a first thickness and the second coating comprises a second thickness.

19. The valve of claim 15, wherein first coating comprises a plurality of thermal barrier coatings, wherein each of the plurality of thermal barrier coatings has at least a space between the plurality of thermal barrier coatings and an adjacent thermal barrier coating of the plurality of thermal barrier coatings.

20. The valve of claim 15, wherein the first coating comprises a plurality of thermal barrier coatings having a hexagonal shape, wherein each of the plurality of thermal barrier coatings has at least a space between the plurality of thermal barrier coatings and an adjacent thermal barrier coating of the plurality of thermal barrier coatings.

* * * * *